US011434073B2

(12) United States Patent
Yamamoto et al.

(10) Patent No.: US 11,434,073 B2
(45) Date of Patent: Sep. 6, 2022

(54) MOBILE COLLECTION SYSTEM WITH DIVERTER APPARATUS

(71) Applicant: SHRED-TECH CORPORATION, Cambridge (CA)

(72) Inventors: David Ken Yamamoto, Paris (CA); Jerrett Timothy Bellamy, Ayr (CA); Matthew Allen Lambert, Kitchener (CA)

(73) Assignee: SHRED-TECH CORPORATION, Ontario (CA)

( * ) Notice: Subject to any disclaimer, the term of this patent is extended or adjusted under 35 U.S.C. 154(b) by 20 days.

(21) Appl. No.: 16/923,720

(22) Filed: Jul. 8, 2020

(65) Prior Publication Data

US 2021/0009347 A1 Jan. 14, 2021

Related U.S. Application Data

(60) Provisional application No. 62/872,559, filed on Jul. 10, 2019.

(51) Int. Cl.

| | |
|---|---|
| ***B65F 3/00*** | (2006.01) |
| ***B65F 3/08*** | (2006.01) |
| *B65F 3/02* | (2006.01) |

(52) U.S. Cl.

CPC ..... *B65F 3/001* (2013.01); *B65F 3/08* (2013.01); *B65F 2003/0223* (2013.01)

(58) Field of Classification Search

CPC ..... B65F 3/001; B65F 3/08; B65F 2003/0223

See application file for complete search history.

(56) References Cited

U.S. PATENT DOCUMENTS

2013/0259614 A1* 10/2013 Vasilescu ..... B65F 3/02 414/406

2014/0314530 A1* 10/2014 Strom ..... B65F 3/001 414/406

* cited by examiner

*Primary Examiner* — Saul Rodriguez
*Assistant Examiner* — Willie Berry, Jr.
(74) *Attorney, Agent, or Firm* — Crowell & Moring LLP

(57) ABSTRACT

Systems and methods are provided for collecting and distributing material. In one embodiment, a collection system comprises at least one storage compartment comprising a plurality of regions. A bin is provided for transporting material from a first environment towards the storage compartment. The system comprises a diverter, wherein the diverter is dimensioned to distribute material among the plurality of regions within the storage compartment. The diverter has a first position during use in which at least a portion of the diverter is positioned below the bin when the bin is in a raised position for emptying material, and at least a portion of the diverter is positioned above the plurality of regions in the first position during use.

20 Claims, 22 Drawing Sheets

MOBILE COLLECTION SYSTEM WITH DIVERTER APPARATUS

PRIORITY CLAIM

This invention claims the benefit of priority of U.S. Provisional Application Ser. No. 62/872,559, entitled "Mobile Collection System with Diverter Apparatus," filed Jul. 10, 2019, the disclosure of which is hereby incorporated by reference in its entirety.

BACKGROUND

The present invention generally relates to mobile collection systems for collecting bulk material such as paper.

Trucks often are used to collect large amounts of paper, such as confidential documents, from commercial or residential buildings and transport the shredded paper to a site where the paper is unloaded for recycling, destruction (e.g., shredding), or other purposes. Such trucks may have on-board equipment for shredding of the paper. Such trucks may use on-board auxiliary equipment to load and unload the paper.

Material is often loaded into motor vehicles to be transported to other locations, for example, for delivery, recycling or destruction. A typical motor vehicle used to transport material includes a bin tipper and one common storage area. Typically, the bin tipper will lift a material-filled bin to a position over the top of the common storage area, and subsequently tip the bin such that the material falls out of the bin and into the storage area.

It can be difficult to distribute material in a uniform and even manner into bins within the storage compartment of a truck. A typical truck may have a storage compartment configured to contain four gaylord boxes within the compartment. A gaylord is a pallet-sized box or bulk container used to store bulk quantities of materials.

It may be desirable to provide an apparatus that delivers material from the bin tipper to the gaylords so as to achieve a uniform and even distribution of the material amongst the gaylords. In particular, by achieving such a distribution, the payload within the storage compartment may be maximized. This allows for fewer trips to collect the same volume of material, and improves efficiency.

SUMMARY

Systems and methods are provided for collecting and distributing material. In one embodiment, a collection system comprises at least one storage compartment comprising a plurality of regions. A bin is provided for transporting material from a first environment towards the storage compartment. The system comprises a diverter, wherein the diverter is dimensioned to distribute material among the plurality of regions within the storage compartment. The diverter has a first position during use in which at least a portion of the diverter is positioned below the bin when the bin is in a raised position for emptying material, and at least a portion of the diverter is positioned above the plurality of regions in the first position during use.

In another exemplary embodiment, a collection system comprises at least one storage compartment, and a bin for transporting material from a first environment towards the storage compartment. A diverter is dimensioned to distribute material within the storage compartment. The diverter has a first position during use in which the diverter distributes material emptied from the bin, and the diverter is configured to move from the first position during use to a second position when the diverter is being stowed.

In another example, a method for collecting material comprises providing at least one storage compartment comprising a plurality of regions, and moving a bin for transporting material from a first environment towards the storage compartment. The method further comprised using a diverter to distribute material among the plurality of regions within the storage compartment.

Other systems, methods, features and advantages of the invention will be, or will become, apparent to one with skill in the art upon examination of the following figures and detailed description. It is intended that all such additional systems, methods, features and advantages be within the scope of the invention, and be encompassed by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Figure 1:
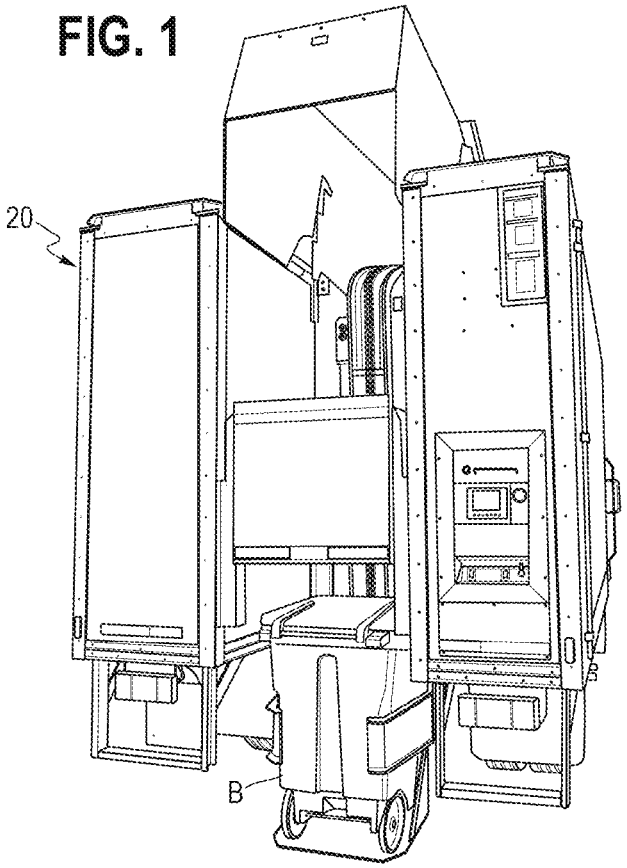
FIG. 1 illustrates a rear view of a vehicle according to at least one embodiment.
Figure 2:
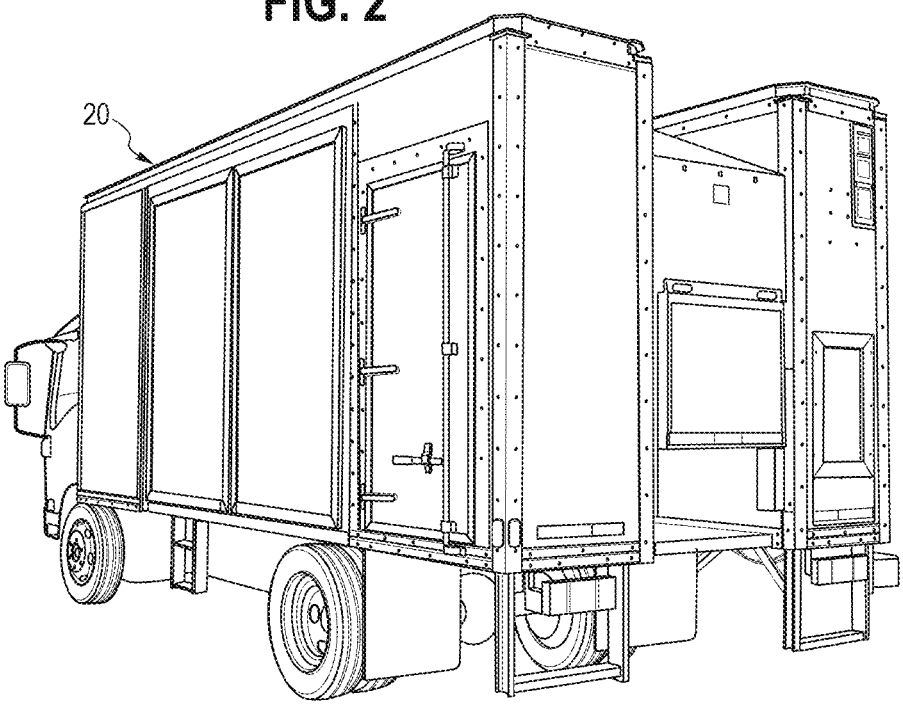
FIG. 2 illustrates a rear perspective view of the vehicle shown in FIG. 1.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

Figure 3:
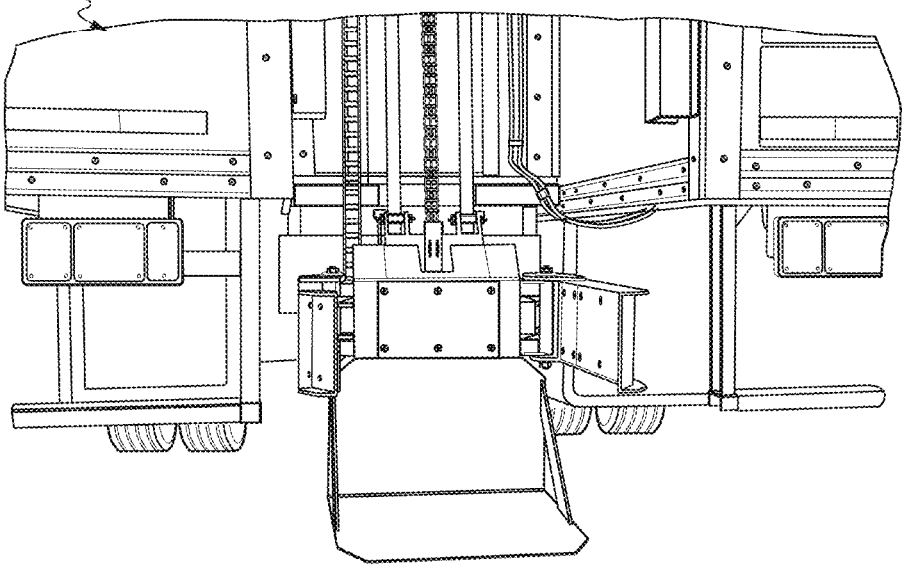
FIG. 3 illustrates a further rear view of the vehicle shown in FIG. 1.
Figure 4:
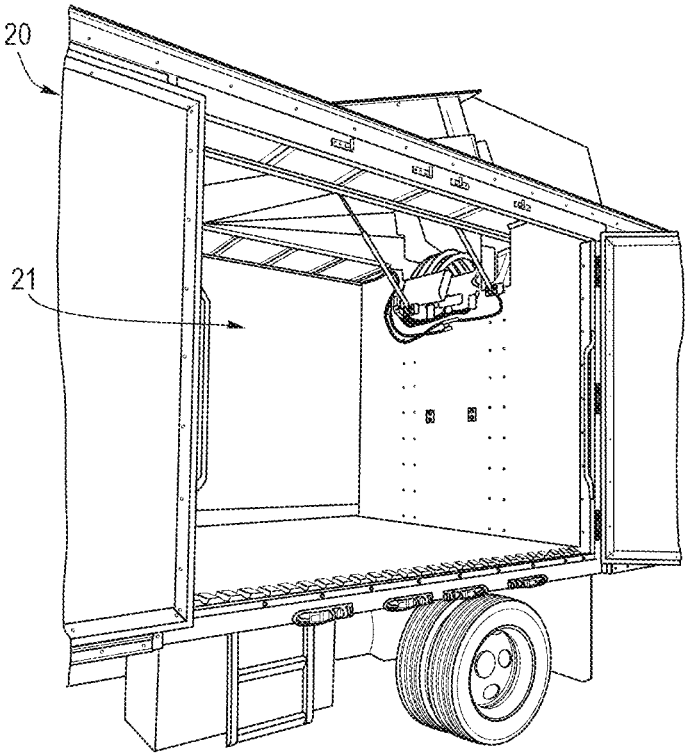
FIG. 4 illustrates a side view of the vehicle shown in FIG. 1.
Figure 5:
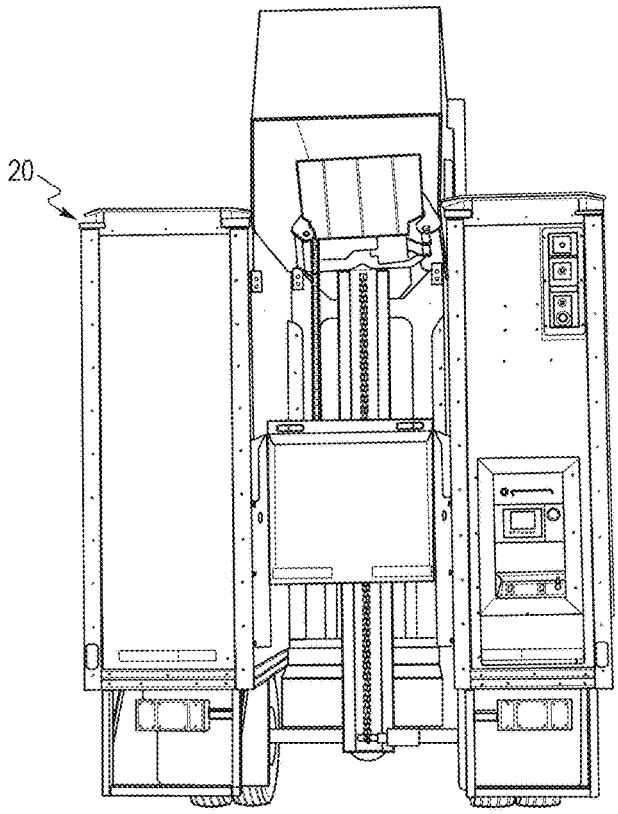
FIG. 5 illustrates a further rear view of the vehicle shown in FIG. 1.
Figure 6:
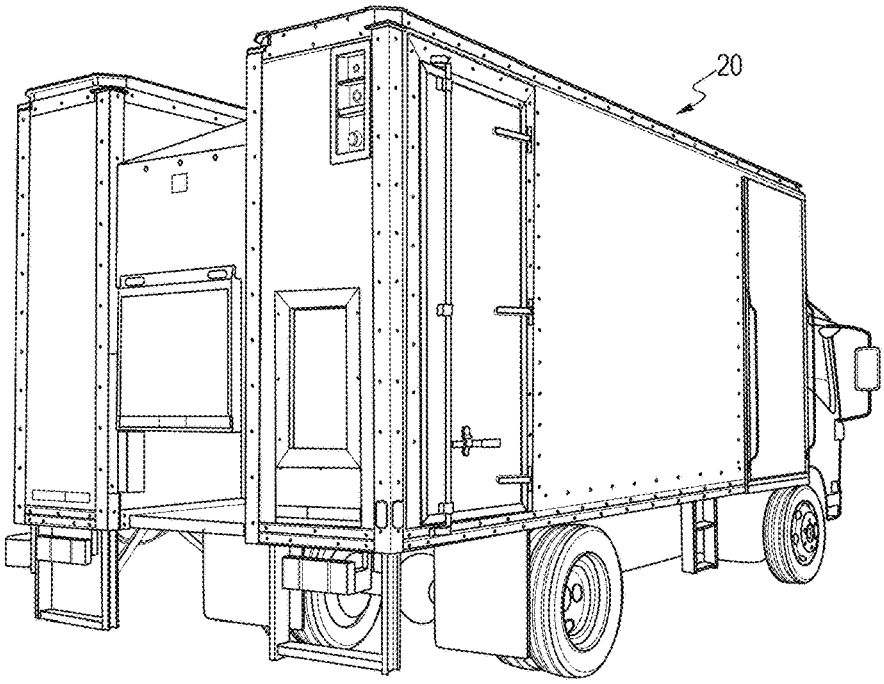
FIG. 6 illustrates a further rear perspective view of the vehicle shown in FIG. 1.
Figure 7:
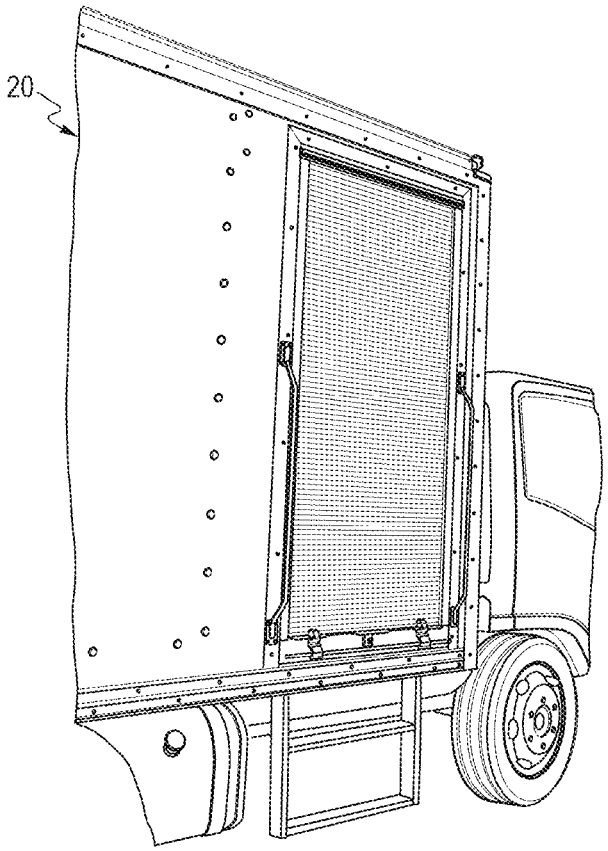
FIG. 7 illustrates another side view of the vehicle shown in FIG. 1.

In at least one embodiment, a diverter is provided as described herein. The diverter of at least one embodiment is configured to be provided in a mobile collection system including a vehicle. The diverter can be provided, for example, in a collection truck 20. As shown in FIGS. 3 and 5, the collection truck 20 may have a conventional bin tipper that is designed to receive a bin B containing bulk material, e.g., paper. A conventional mechanism can be provided to lift and tip the bin B to drop the bulk material into a storage compartment 21 of the collection truck 20. Exemplary mobile collection systems and exemplary vehicles are described, for example, in U.S. Pat. Nos. 9,598,235 and 10,661,987, the entire contents of which are incorporated herein by reference. While described in connection with a collection vehicle (e.g., a vehicle that collects material for delivery to a site for further processing), the diverter also could be used in connection with a vehicle having on-board shredding equipment.

In at least one embodiment, a diverter is structured so as to be movable between at least a first position that is a use position and a second position that is a stowed position when the diverter is not in use.

Figure 8:
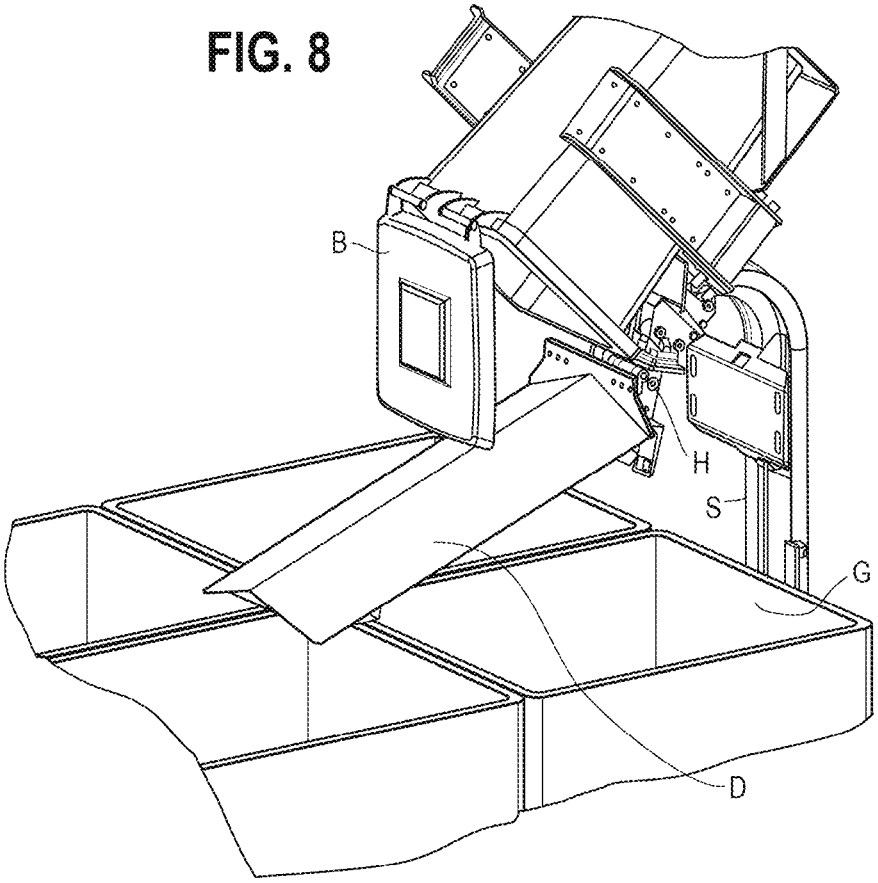
FIG. 8 illustrates a perspective view of a diverter according to at least one embodiment, in which the diverter is positioned over a plurality of gaylords.

In at least one embodiment, a diverter is configured to distribute a quantity of material across a plurality of gaylords and, preferably, in a substantially uniform distribution amongst a plurality of gaylords. For example, when there are four gaylords in the storage compartment of a truck, the diverter preferably is configured to distribute approximately a quarter of a quantity of material to each of the four gaylords. FIG. 8 shows an exemplary arrangement of four gaylords G with a diverter D disposed atop the gaylords. A bin B is positioned such that material from the bin is directed via the diverter to the gaylords. A hinge H connects the diverter to a support S, which may, in some embodiments, include a portion shaped as a cane (with a stem and a hooked portion above the stem). In at least one embodiment, as shown in FIG. 8, the diverter D may be constructed with two angled pieces that join each other at a seam along the centerline of the diverter D.

In at least one embodiment, the diverter is structured so as to rest on and be supported by one or more gaylords when in the use position and/or the stowed position. However, in other embodiments, the diverter is configured to be used when it is not resting on any gaylord—that is, the diverter is in a use position when it is not contacting a gaylord. In some embodiments, a use position is one in which the diverter is not contacting any gaylord and is angled upward relative to an imaginary plane above the upper surface of the gaylords, so as to extend freely into the storage compartment.

Further, in at least one embodiment, the diverter is configured to be movable so as to obtain a plurality of positions. For example, in at least one embodiment, the diverter is movable to a fully extended position which is a use position, a fully retracted position which is a stowed position, and one or more intermediate positions. Moreover, in at least one embodiment, the diverter is operational in a plurality of positions, so as to be utilizable at, for example, a first use position, a second use position, a third use position, and so forth.

In at least one embodiment, the diverter is structured so as to rest on and be supported by one or more gaylords at least in the stowed position.

In at least one embodiment, the diverter is configured to be positioned within the storage compartment of the truck so as to distribute material when the bin tipper is centered (i.e., on center) with respect to the gaylords, but off center with respect to the storage compartment of the truck.

Figure 11:
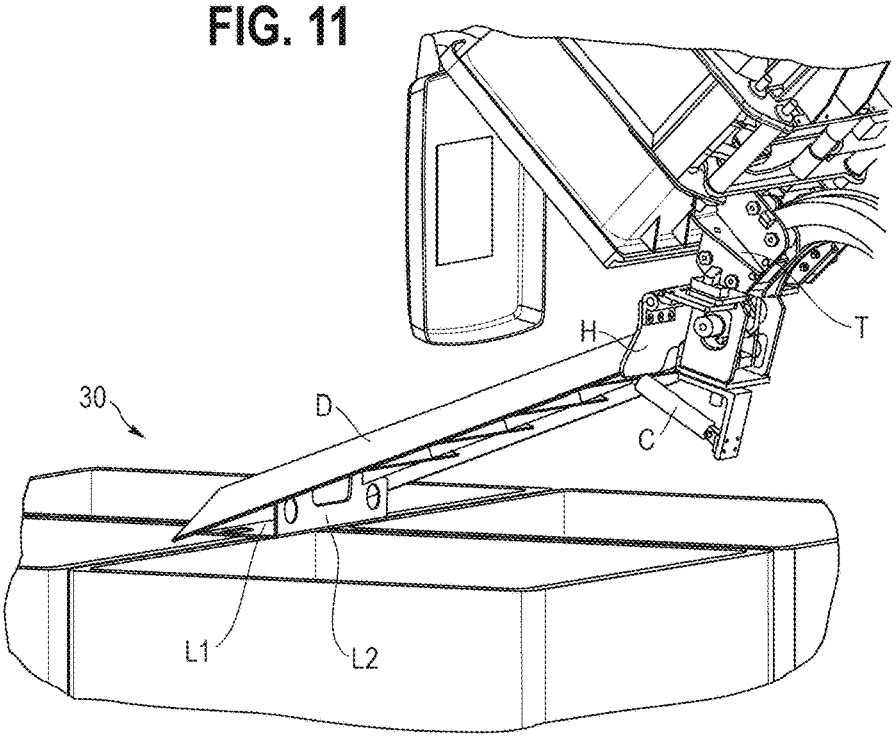
FIG. 11 illustrates a perspective view of a diverter according to at least one embodiment, in which the diverter is positioned over a plurality of gaylords.
Figure 12:
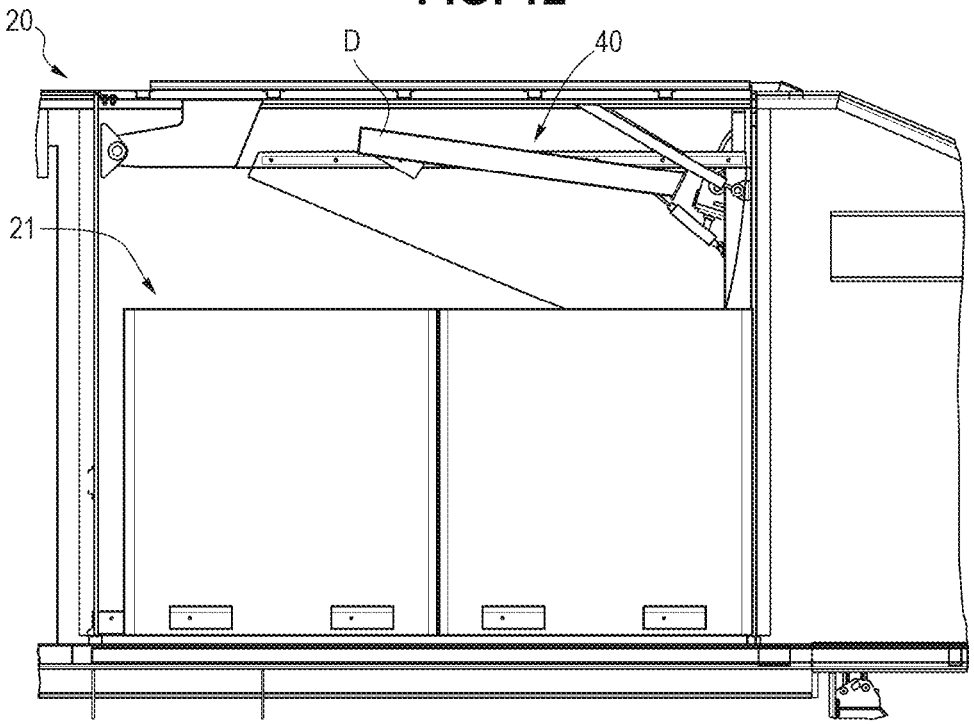
FIG. 12 illustrates a side schematic view of a diverter provided for a storage compartment of a vehicle according to at least one embodiment.

As shown in the embodiment of FIGS. 8-12, the diverter D can be positioned so as to be below the bin B when the bin tipper has raised the bin to drop its contents into the storage compartment. The position of the diverter below the bin causes the diverter to divert the bulk material dropping out of the bin into different gaylords or subcompartments in the storage compartment of the vehicle. As shown in FIGS. 11 and 12, the diverter can be disposed in a use position 30 and a stowed position 40, respectively. The diverter D can be, for example, mounted on the end of the bin tipper T by, e.g., a hinge H, such that the diverter can be rotated upwards from the use position 30 of FIG. 11 to the stowed position 40 of FIG. 12. The diverter can be driven through the rotation by a drive cylinder C or other movement-causing structure.

Figure 17:
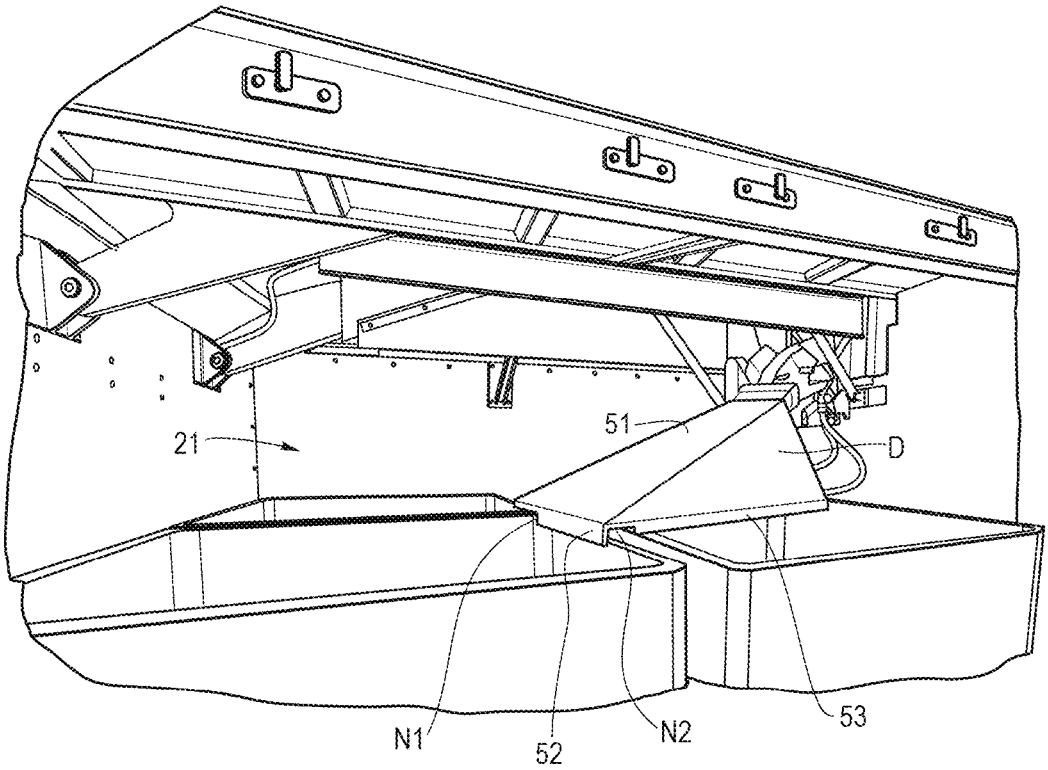
FIG. 17 is a side view that illustrates use of a diverter according to at least one embodiment.

As shown in FIG. 17, in at least one embodiment, the diverter D includes a chute 51 having a front plate 52. The front plate 52 is structured to include a notch N1 at an approximate midpoint of the front plate. The notch N1 is dimensioned so as to accommodate two sidewalls of adjacent gaylords. When the front plate is positioned where two gaylords are adjacent (where the sidewall of a first gaylord abuts a sidewall of a second gaylord), the sidewalls fit between the notch, and the front plate rests on the sides of the gaylord. Similarly, a side plate 53 of the diverter is provided with a notch N2 so as to accommodate two sidewalls of adjacent gaylords that are perpendicular to the sidewalls accommodated within the notch of the front plate. In at least one embodiment, a method of using the diverter includes positioning the diverter over the gaylords, actuating a bin tipper to discharge material, and employing the diverter to guide the material from the bins to the gaylords.

In at least one embodiment, due to the weight of the diverter, the placement of the diverter on the sidewalls of the gaylords helps to lock the gaylords in position. Typically, there is a slight gap between gaylords within the compartment of a truck, e.g., about 1-2 inches. By positioning the diverter such that the notches in the diverter plates accommodate the sidewalls of the gaylords, the gaylords shift less during transit, and thereby do not enlarge the gap. Accordingly, there is a reduced risk of paper falling through the gaps. Further, the gaylords help in at least one embodiment to support the weight of the diverter.

In at least one embodiment, as shown, for example, in FIG. 12, a hinge is provided at the bin tipper, with a gas spring to allow the diverter to tilt up when the gaylords are removed from the storage compartment of the truck. The diverter may be coupled to the hinge in a manner that allows ready movement between the use position 30 and the stowed position 40.

Figure 9:
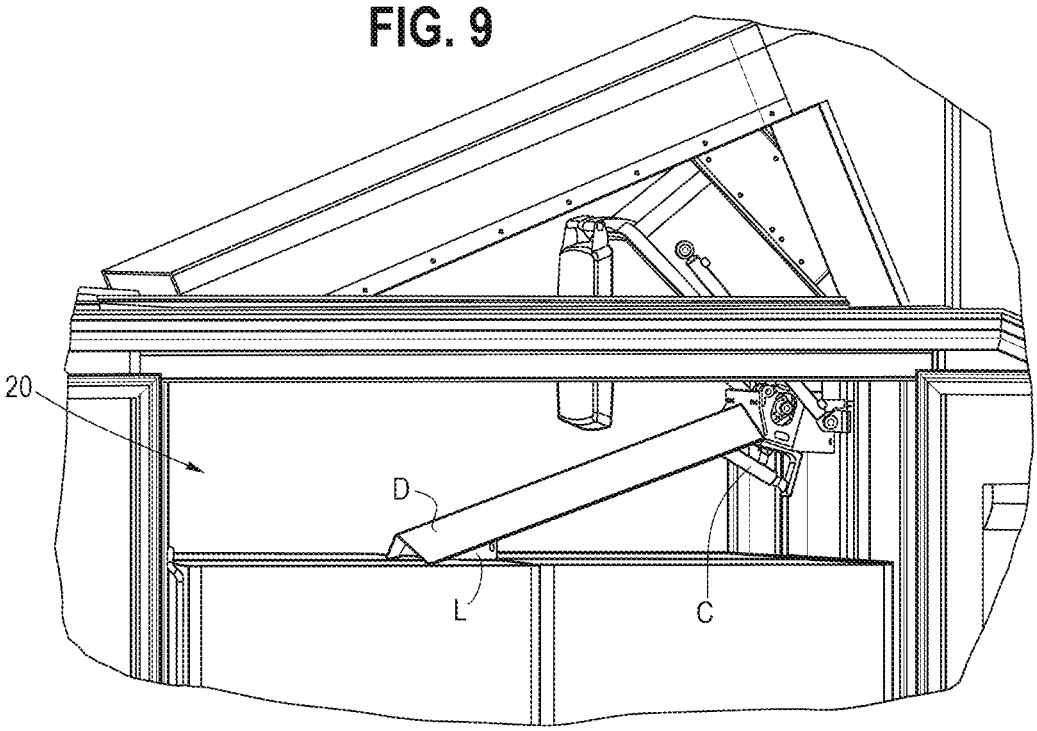
FIG. 9 illustrates a side view of the diverter shown in FIG. 8
Figure 10:
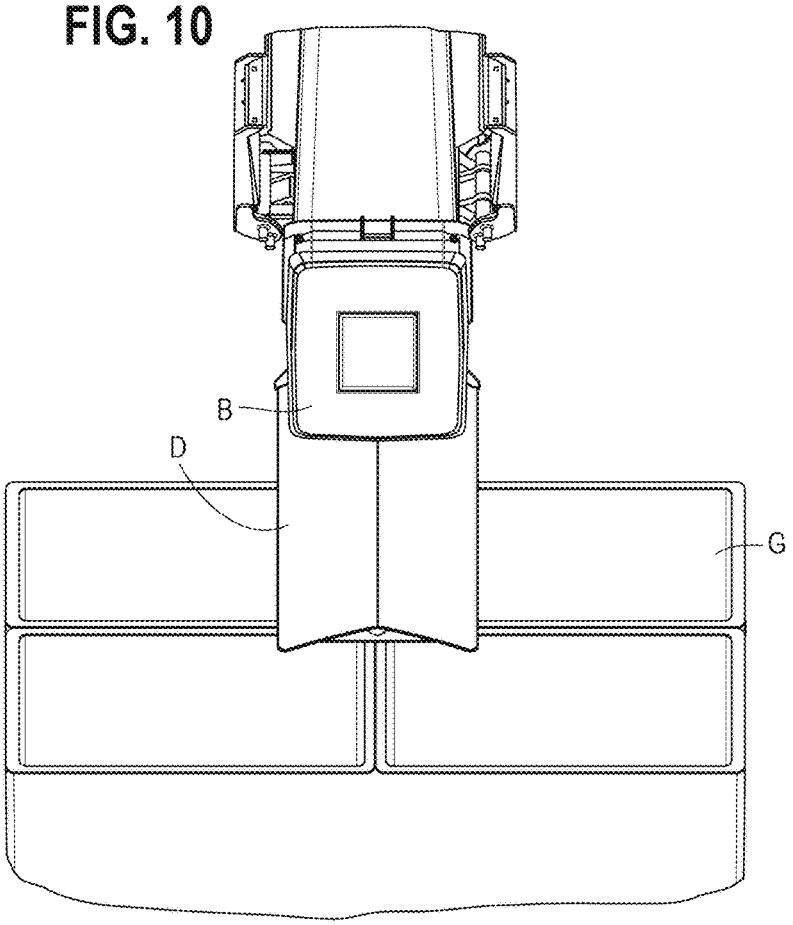
FIG. 10 illustrates a top view of the diverter shown in FIG. 8.

Further, in at least one embodiment, the diverter is configured to move to the stowed position with a clearance between the stowed diverter and the gaylords. As shown in FIG. 9, the diverter may include a ledge portion L that is supported directly on the gaylords when the diverter is in the use position. As shown in FIG. 11, in at least one embodiment, the ledge is made up of a horizontal piece L1 configured to be disposed flush against a top of one or more gaylords and a vertical piece L2 configured to contact an underside of the diverter at a portion away from the lowermost edge of the diverter.

When in the stowed position, both the ledge L and the remainder of the diverter D may be moved such that none of the diverter contacts the gaylords. In particular, when the gaylords are removed from the storage compartment from the truck, the clearance allows the gaylords to be taken out without contacting the diverter. Namely, the clearance facilitates easy removal of bins from the truck. In at least one embodiment, a pneumatic mechanism may be used to actuate movement of the diverter from the use position to the stowed position. As noted above, in at least one embodiment, the use position may be one in which the diverter does not contact any gaylord.

For example, a gas spring mechanism (e.g., gas cylinder C in FIG. 9) may be used to lift the diverter D to the stowed position when the gaylords are extracted from the storage compartment. The gas spring mechanism may also be used to maintain the diverter in position during use. For movement of the diverter between the use and stowed positions 30 and 40, respectively, the gas spring mechanism is configured to create sufficient lift to effectively maneuver the diverter (e.g., above the tops of the gaylords). In some embodiments, hydraulic and/or electric actuators may be used instead of or in addition to the gas spring mechanism.

In at least one embodiment, the actuation allows side-to-side movement of the diverter D within a range of motion. Further, the diverter may be provided with the hinge H so as to pivot at the bin tipper T, as shown in FIG. 11. More particularly, the actuator allows for the diverter to tilt vertically at the hinge H to allow the diverter to achieve a plurality of positions, including but not limited to the use position 30 and the stowed position 40.

In at least one embodiment, the diverter may be so-called "smart" diverter with one or more actuators to change various configurations of the diverter. For example, the diverter may be outfitted with one or more ailerons, i.e., wing flaps, which are attached to one or more sides of the diverter in such a way that the wing flaps can be moved relative to the remainder of the diverter. The wing flaps may be moved up or down so as to change the diverter shape and/or orientation, and thereby control the flow of material via the diverter. Though described as being moved by actuators, the wing flaps also could be configured to be moved manually.

Moreover, in at least one embodiment, a non-transitory computer-readable medium is provided that stores instructions executable by one or more processors to perform a control process for controlling actuation of any part of the diverter. For example, a microcomputer including a microprocessor may be used to control a diverter position, e.g., the timing of the movement from a first position to a second position, the degree of lift of a wing flap, the extension or retraction of a component, and so forth.

Further, in at least one embodiment, one or more surfaces of the diverter may have a textured or featured surface to lower friction and to promote the flow of material at a low slope angle. For example, the diverter may include a portion with an indented and/or upwardly oriented spherical shape. In some embodiments, a surface of the diverter may be at an angle of about 20° to about 40° with respect to an imaginary plane extending across the upper surface of the gaylords.

Further still, in at least one embodiment, a surface of the diverter may include integrated ball bearings and/or be provided with a low friction coating such as a graphite lubricant. For example, in some embodiments, one or more portions of the diverter may be coated with a dry film lubricant such as "Slip Plate" Graphite Lubricant made by Superior Graphite Corporation of Chicago, Ill.

Additionally, in at least one embodiment, a vibratory mechanism (vibrator) may be provided with the diverter (e.g., integrated therein) to vibrate the diverter and promote the flow of material from the diverter and into the gaylords.

In addition, in at least one embodiment, the diverter may be structured as a chute, with one or more baffles provided on an interior and/or exterior thereof to promote the flow of material and guide the material to the gaylords.

Further, in at least one embodiment, the diverter may be provided in a storage compartment in which there are no gaylords, or a combination of open space and gaylords. For example, when there are no gaylords, the diverter may be employed to distribute material more evenly across a walking floor of a vehicle.

Figure 13:
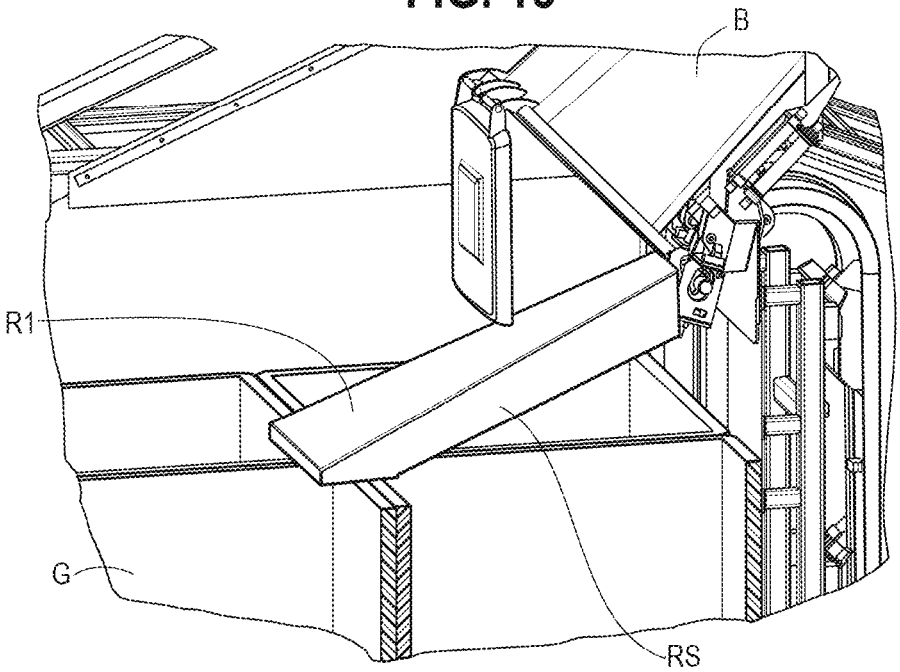
FIG. 13 illustrates a perspective view of a diverter according to at least one embodiment.
Figure 14:
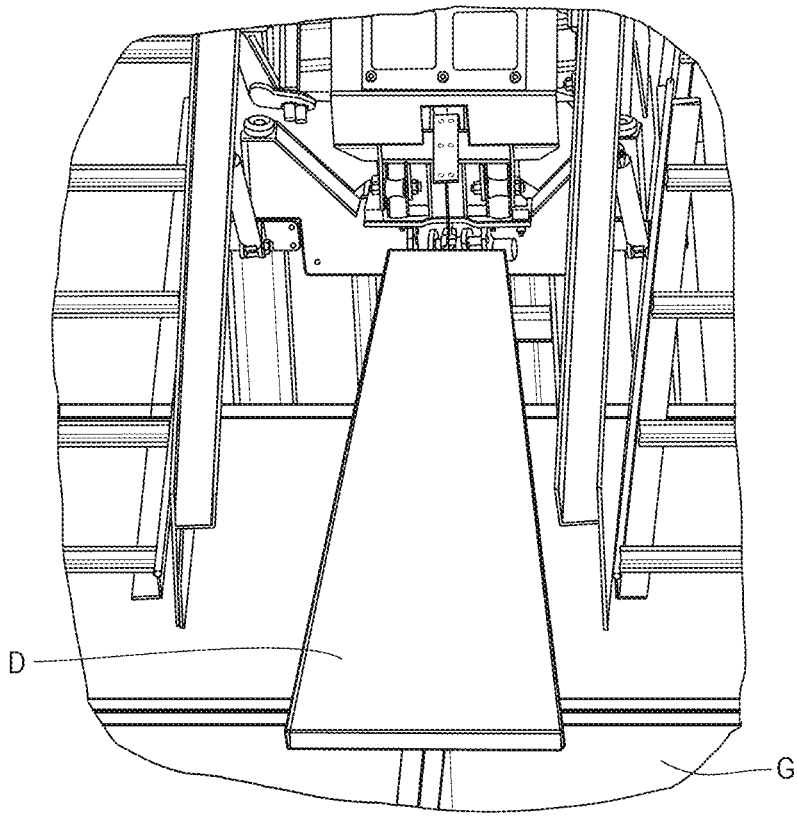
FIG. 14 illustrates a top perspective view of a diverter according to at least one embodiment.

As seen in FIG. 13, the diverter includes a portion having a flat top and is configured as a ramp. The ramp has a ramp surface R1 that is an upper surface of the diverter, and which has sidewalls RS on lateral sides of the ramp surface. The narrow configuration of the diverter allows for paper to fall to the sides of the diverter into the gaylords. The flat configuration further allows for paper to travel to the front of the diverter (a portion farthest from the hinge that attaches the diverter to a stationary support).

Figure 15:
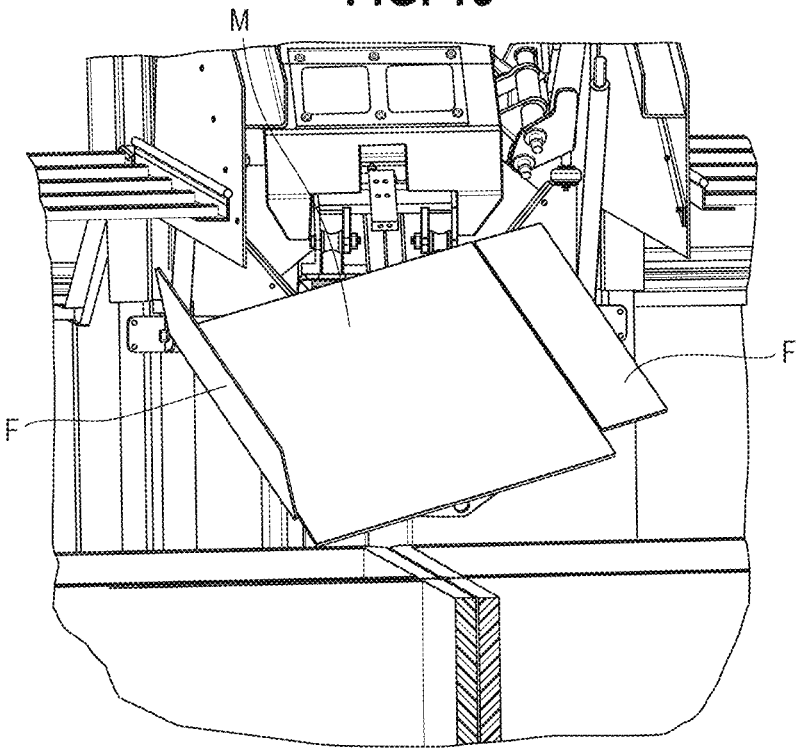
FIG. 15 is a side view that illustrates a diverter in a first position, according to at least one embodiment.
Figure 16:
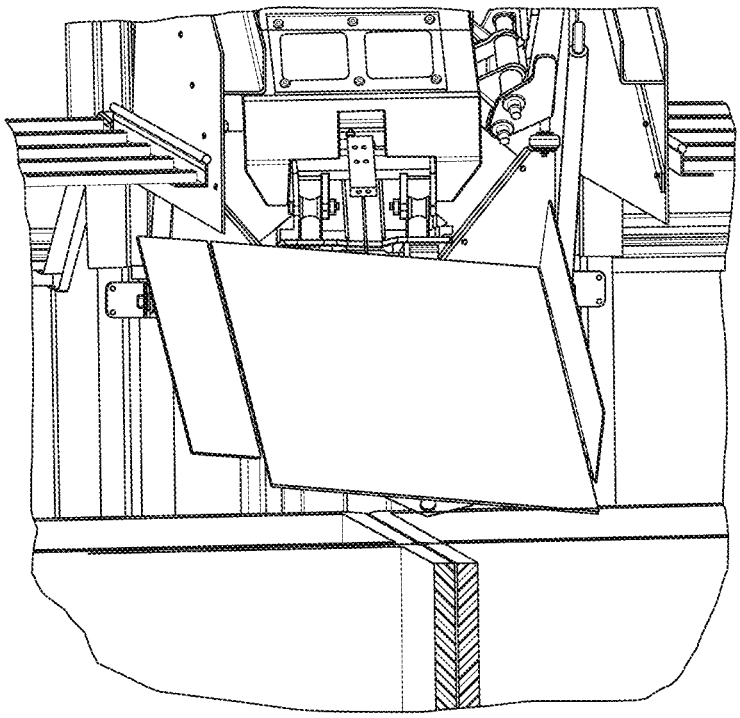
FIG. 16 is a side view that illustrates the diverter shown in FIG. 15 in a second position.

The diverter shown in FIG. 15 is configured to be rotatable and to have ailerons (side wing flaps) that are "active"

flaps F that can be lifted and/or lowered (either manually or via a conventional mechanism for causing such lifting and lowering). As seen in FIG. 15, the active flaps F are disposed on sides of a main piece M of the diverter (a central plate or main body portion). The active flaps allow for material to be guided to the far left-most or far right-most gaylords among a plurality of gaylords stored in a storage compartment. Lowering one or more of the flaps and tilting the diverter allows material to flow to the centermost gaylords in at least one embodiment.

Figure 18:
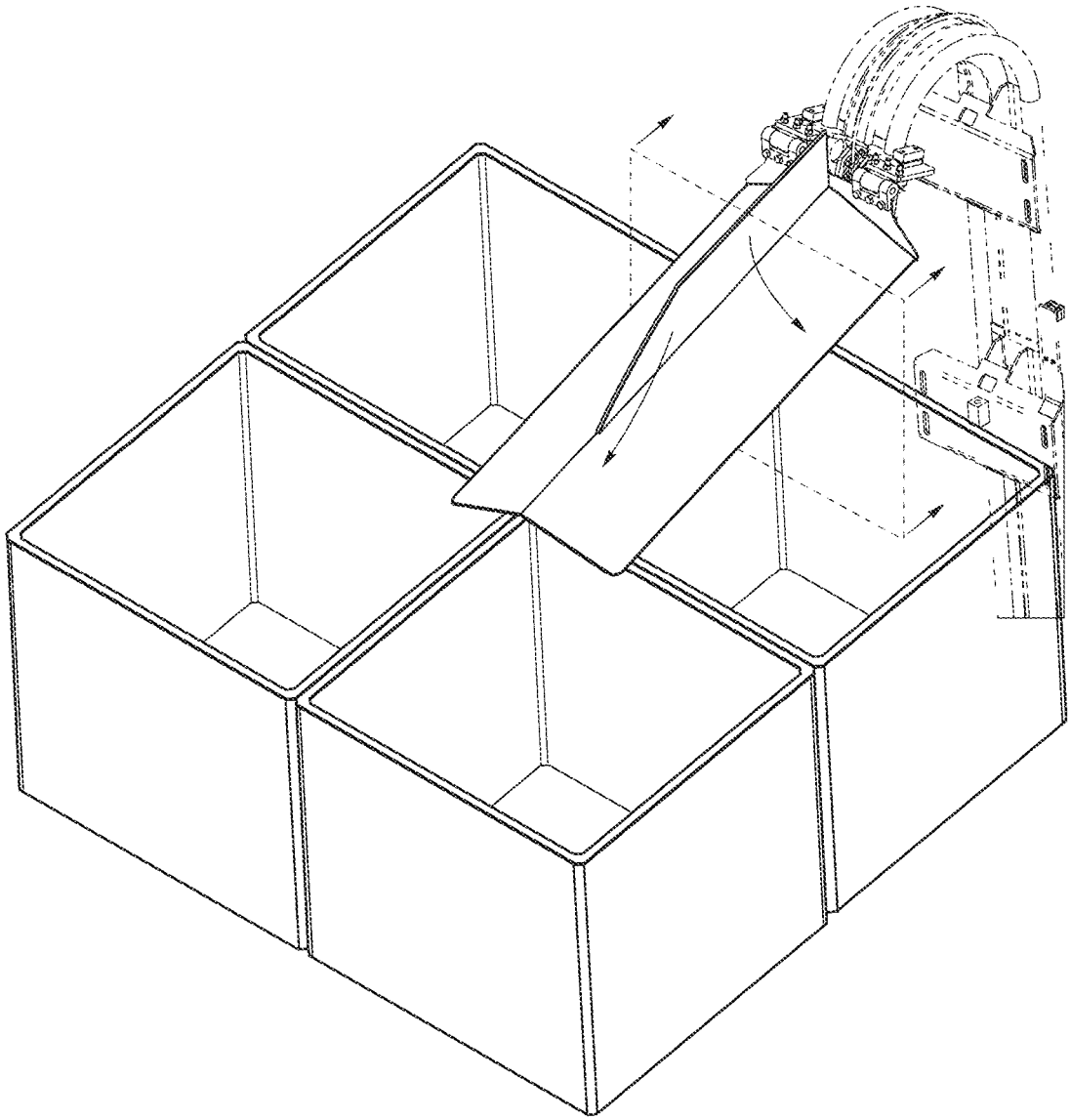
FIG. 18 is an elevated perspective view of a diverter according to at least one embodiment.

In at least one embodiment, a vertical splitter may be employed, including, for example, in the embodiment shown in FIG. 18. The vertical splitter sets the flow of paper as it is falling from the bin apex in the fore or aft directions. The location may impact the volumetric flow in the fore or aft directions. In particular, placement of the splitter may result in a smoother transition in the flow direction, allowing for a higher forward speed and a more even paper distribution. In some embodiments, the splitter may be extendable and/or retractable.

Figure 19:
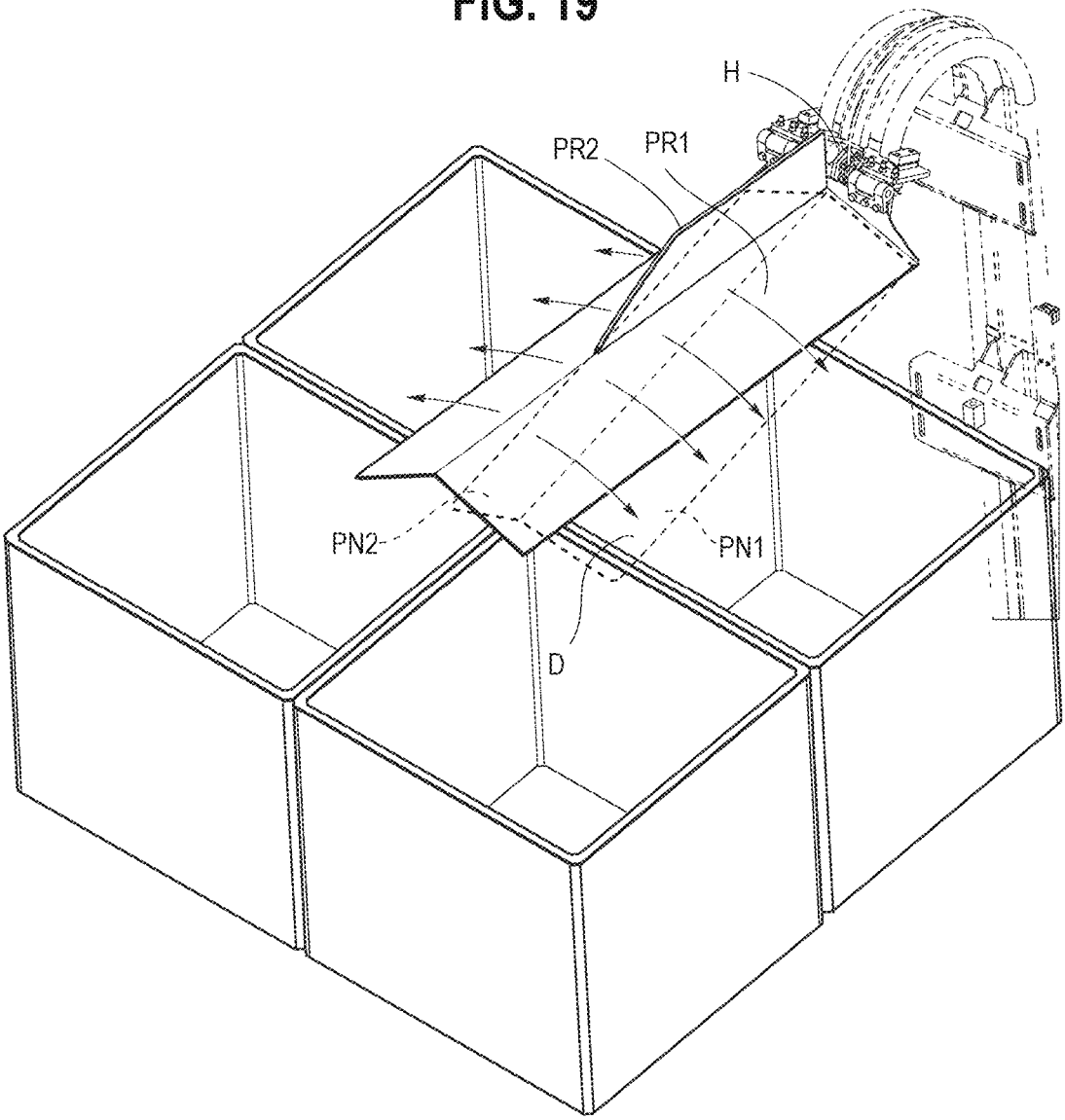
FIG. 19 is an elevated perspective view of a diverter according to at least one embodiment.

In at least one embodiment, e.g., FIG. 19, the diverter may be elevated. For example, by elevating the diverter, material may be shed to the sides of the diverter. A vertical splitter as discussed above may facilitate a clean split (diversion) of material, e.g., causing the flow of material to diverge to left and right sides of the diverter.

FIG. 19 depicts the diverter D in a raised position and in a normal position during use. Specifically, the diverter D includes two angled portions joined at a seam, similar to the diverter described above in connection with FIG. 8. That is, the sloped portions form left and right halves of the diverter body. When the diverter is raised, the left portion is in position PR1, and the right portion is in position PR2. The raising of the diverter may be accomplished according to lifting and/or actuating mechanisms as described herein. When raised, a downward slope from the bin tipper (e.g., tipper T shown in FIG. 11) to the far gaylords is reduced, such that material may be distributed primarily to side portions (e.g., gaylords nearer to the bin tipper rather than gaylords that are farther from the bin tipper). In contrast, in the normal position, the diverter is more sloped in the downward direction so as to facilitate guiding material to the far gaylords. When the diverter is in a normal position, the left portion is in position PN1, and the right portion is in position PN2. A hydraulic cylinder mechanism may be used to move the diverter portions, e.g., to/from the raised or normal positions.

Figure 20:
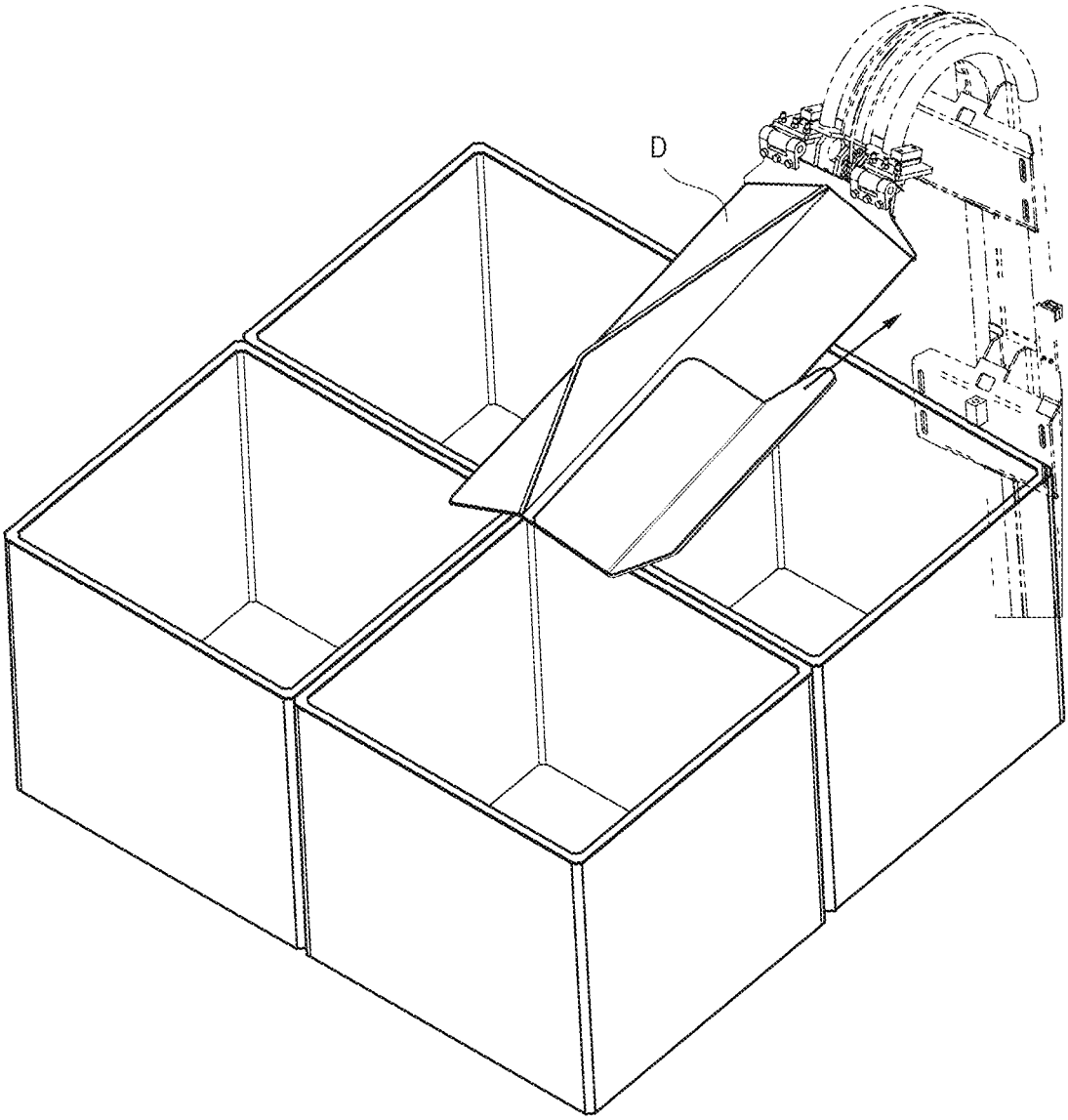
FIG. 20 is an elevated perspective view of a diverter according to at least one embodiment.

In at least one embodiment, such as in FIG. 20, a diverter D may include retractable segments configured to open/close, so as to expand/retract (e.g., manually or via a conventional mechanism for causing such opening and closing). For example, in a retracted position, the diverter allows for material to be discharged to an inner gaylord (that is, one or more gaylords proximate to the diverter, e.g., the innermost gaylords). In an extended position, the diverter allows for material to be discharged to outer gaylords (one or more outermost gaylords). The diverter may include an upward sloped wing to allow material to be directed to the outer gaylords.

Figure 21:
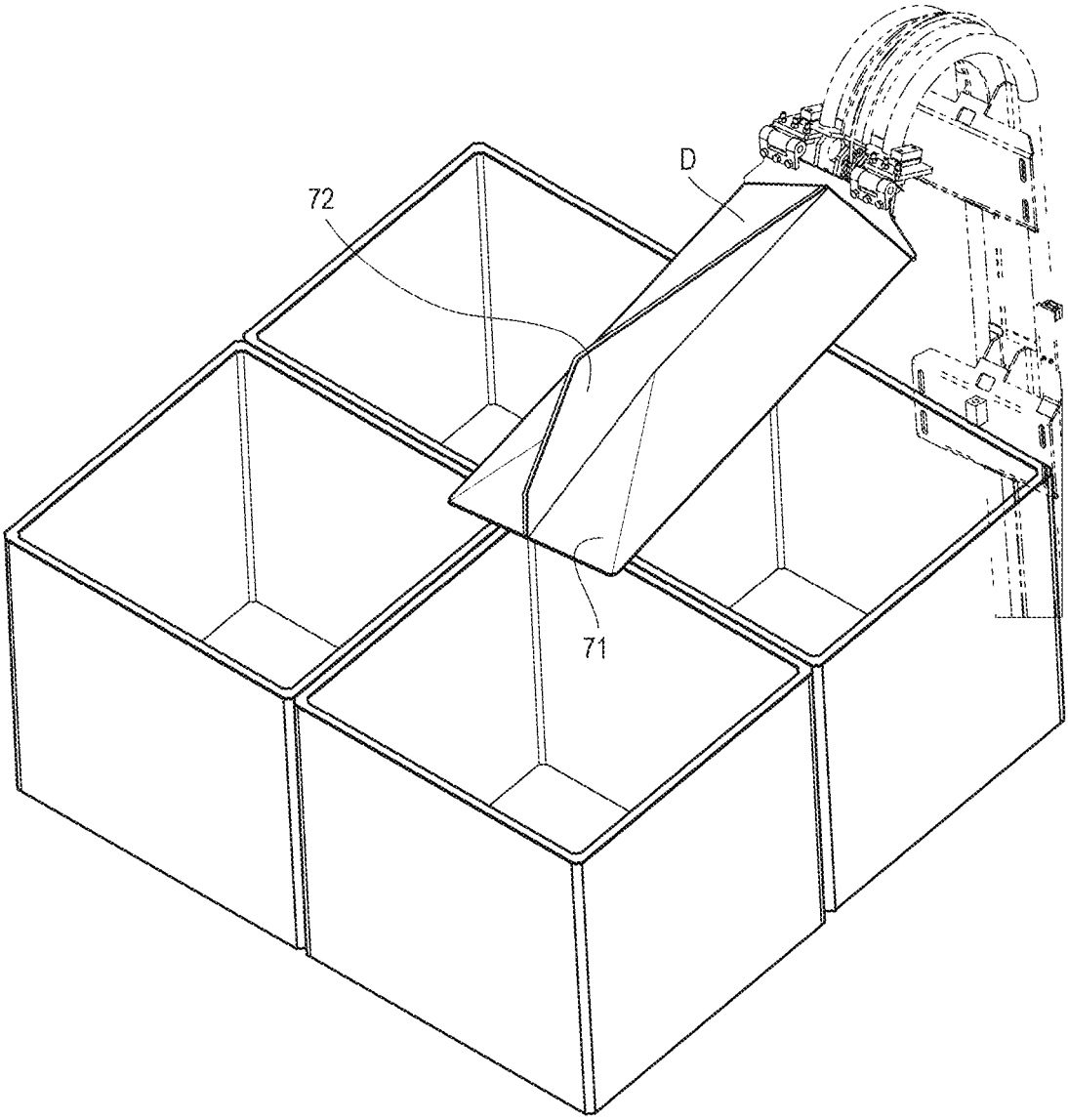
FIG. 21 is an elevated perspective view of a diverter according to at least one embodiment.

In at least one embodiment, such as in FIG. 21, a diverter D may be constructed with a sloped end 71 and a vertical splitter 72 to direct material forward to a diverter plate, which is positioned to deflect material so it does not accumulate and rest on the top of the gaylord walls.

Figure 22:
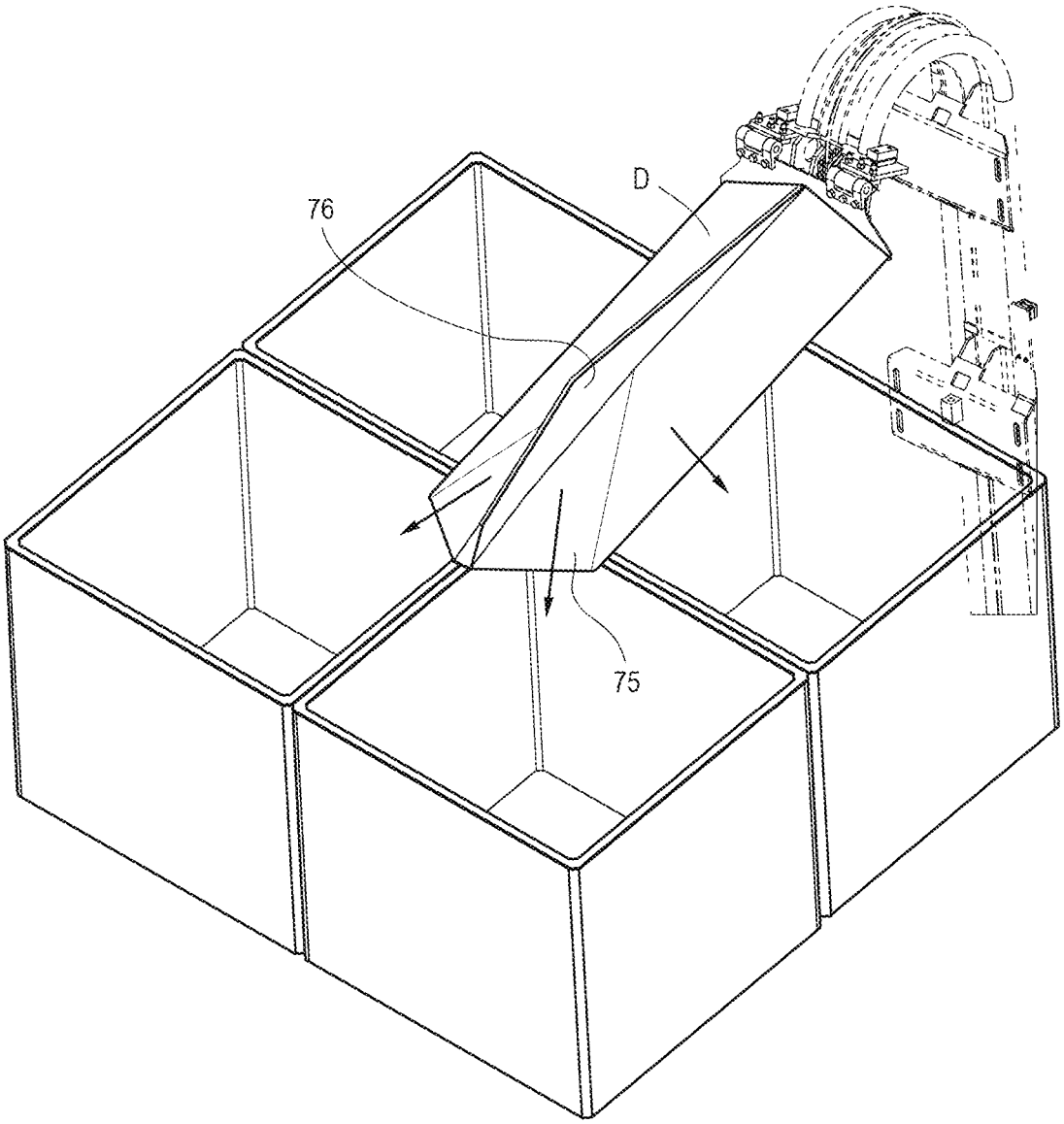
FIG. 22 is an elevated perspective view of a diverter according to at least one embodiment.

In at least one embodiment, such as in FIG. 22, a diverter D may be constructed with a directional sloped end 75, a splitter 76, one or more guide components, and an apex location to facilitate uniform distribution to the gaylords.

Figure 23:
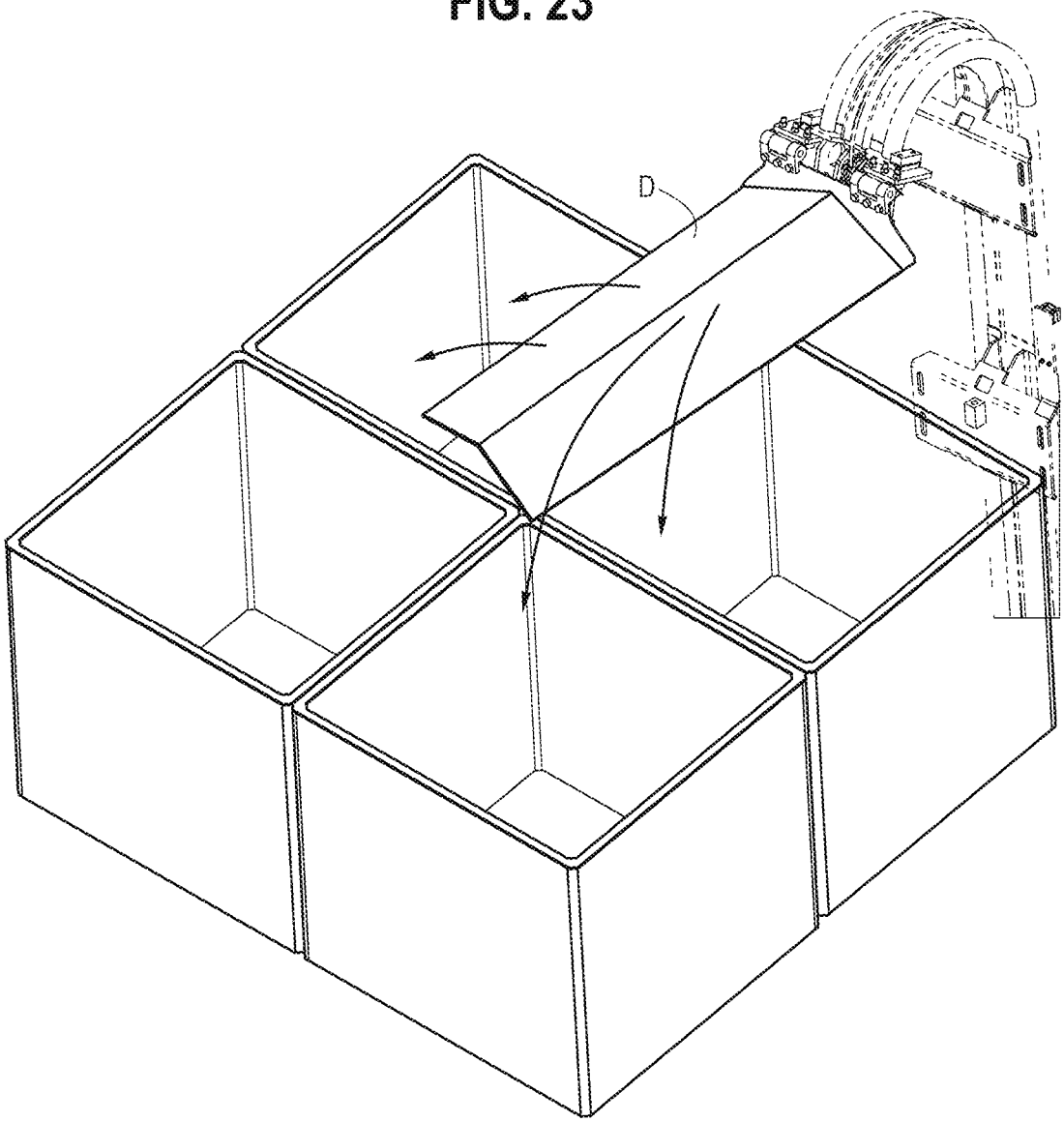
FIG. 23 is an elevated perspective view of a diverter according to at least one embodiment.

FIG. 23 depicts a diverter D rotated in a clockwise direction, with the center of the impact of the material on a sloped surface of the diverter. It is preferable in at least one embodiment to position the diverter such that flow to the driver side gaylords occurs, with some flow of material to the passenger side gaylords. When rotated counterclockwise, the diverter allows for flow of material to the passenger side.

Figure 24:
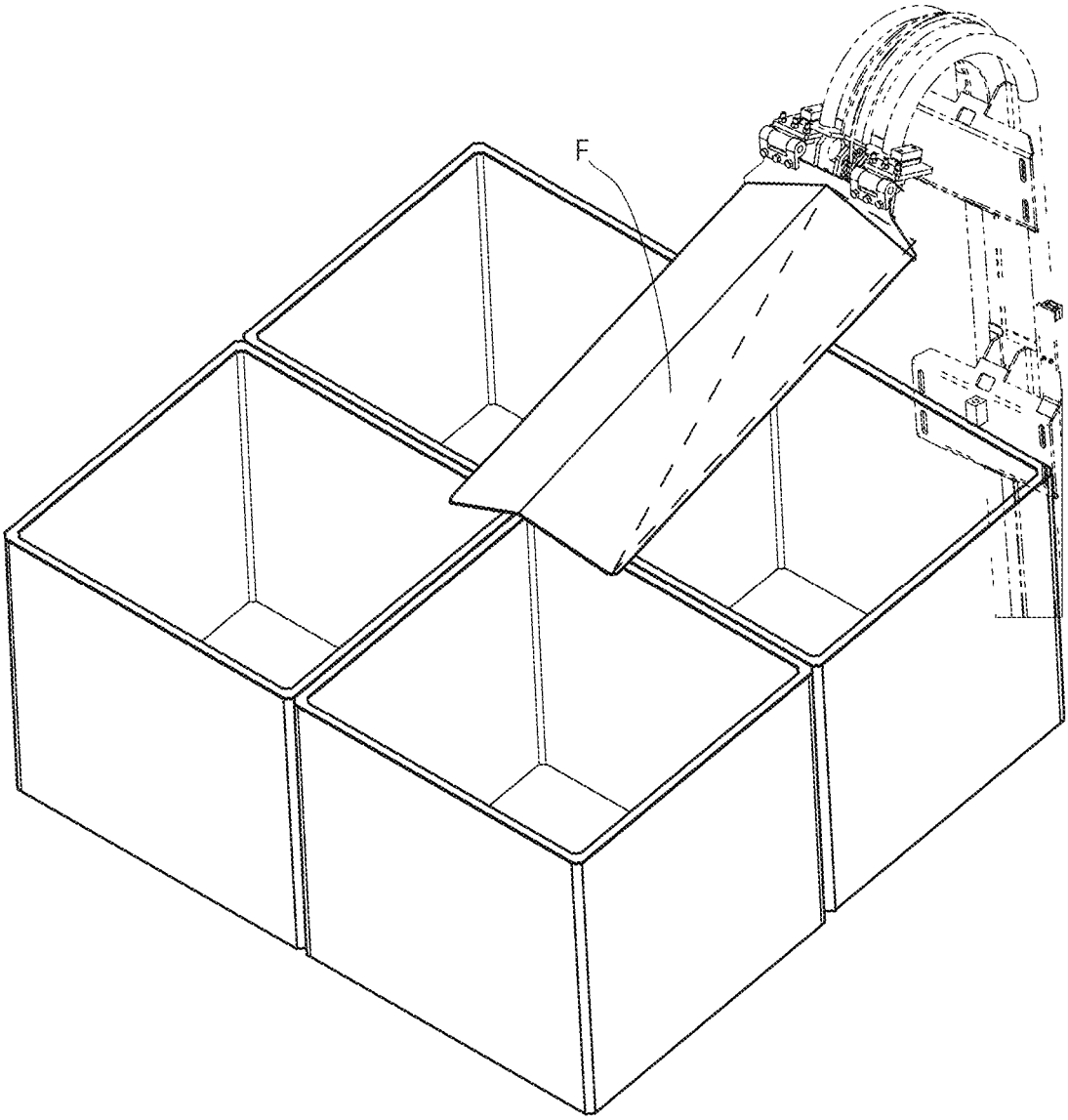
FIG. 24 is an elevated perspective view of a diverter according to at least one embodiment.

FIG. 24 depicts a diverter according to at least one embodiment. As shown in FIG. 24, the diverter includes a flap F. When raised, the flap allows material to be guided to the far (outer) gaylords. The flap can be raised or lowered manually or via a conventional mechanism that causes such raising or lowering.

Figure 25:
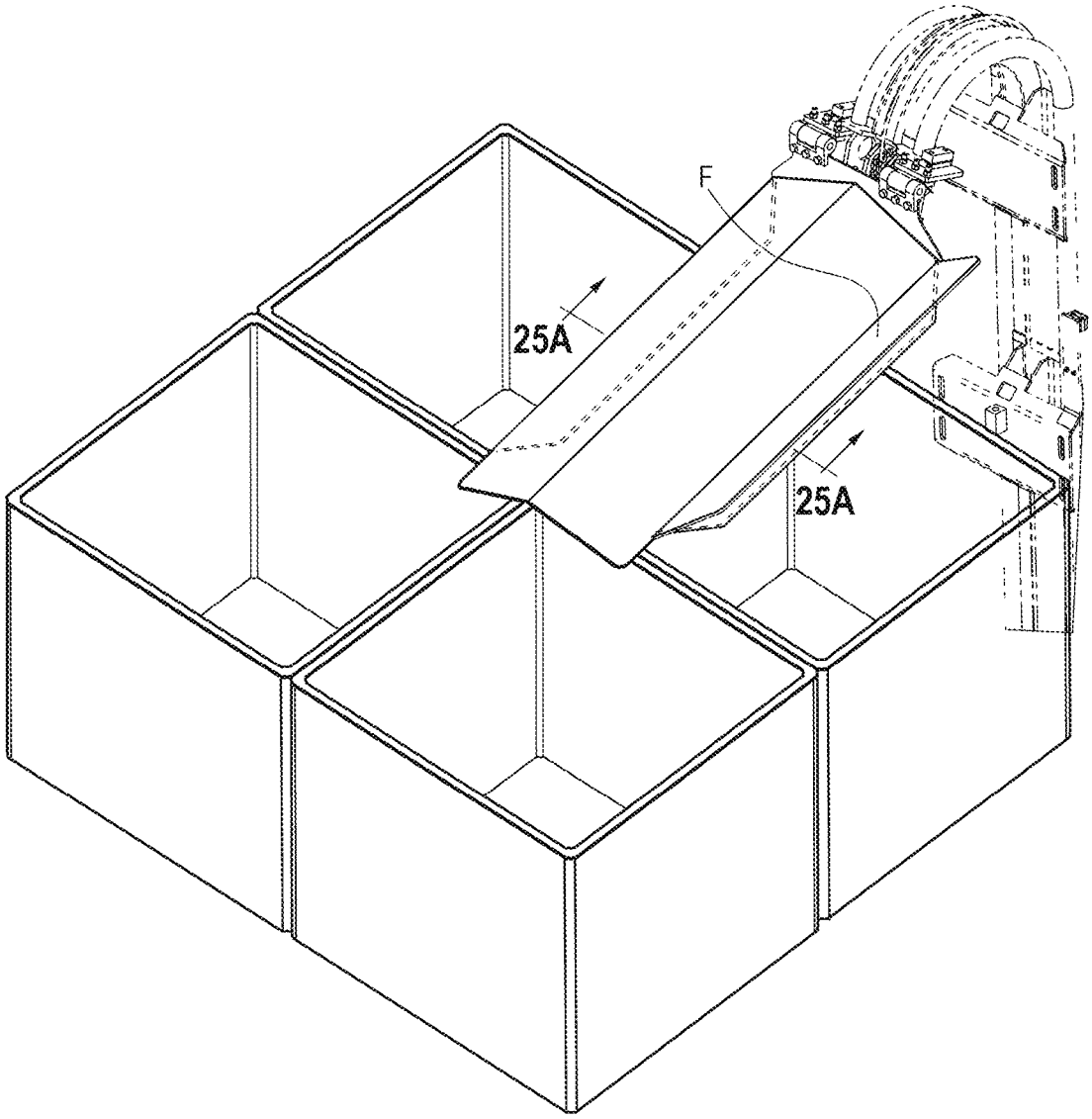
FIG. 25 is an elevated perspective view of a diverter according to at least one embodiment.
Figure 25A:
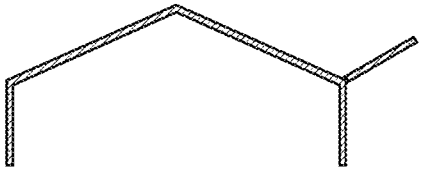
FIG. 25A is a cross-sectional view taken along line 25A-25A of FIG. 25.

FIG. 25 depicts a diverter according to at least one embodiment. The diverter includes a flap F raised to feed material to a driver's side far gaylord, while FIG. 25A is a cross-sectional view along line 25A-25A of FIG. 25.

Figure 26:
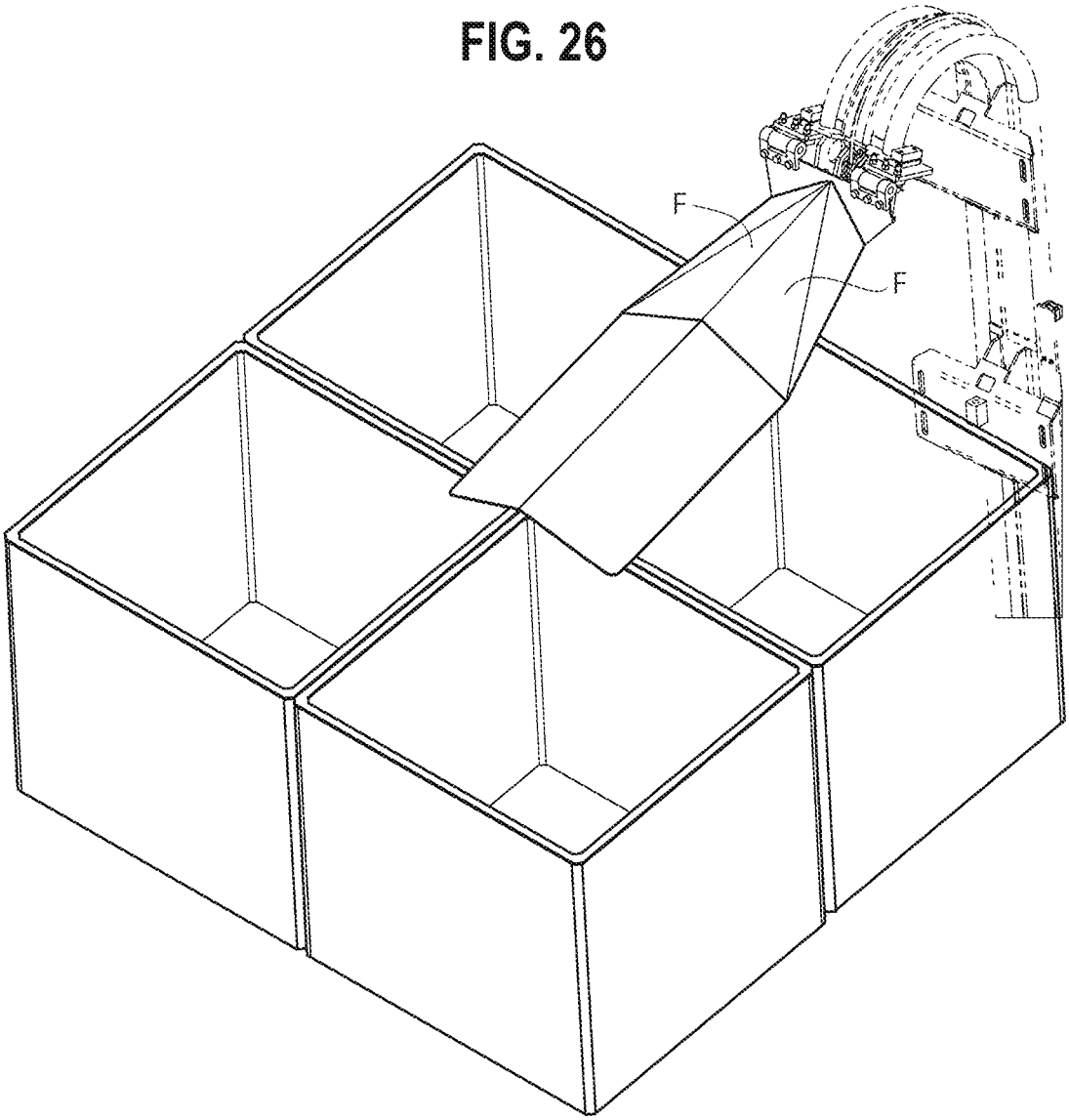
FIG. 26 is an elevated perspective view of a diverter according to at least one embodiment.
Figure 27:
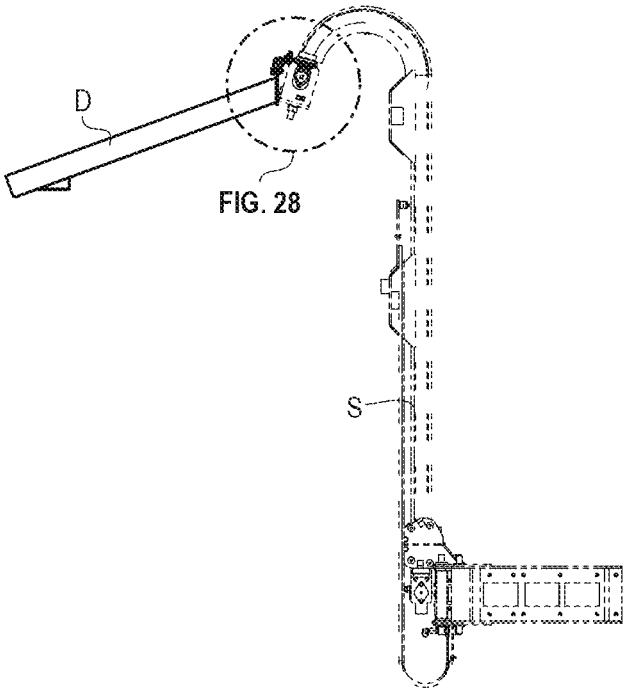
FIG. 27 is a side view of a diverter according to at least one embodiment.
Figure 28:
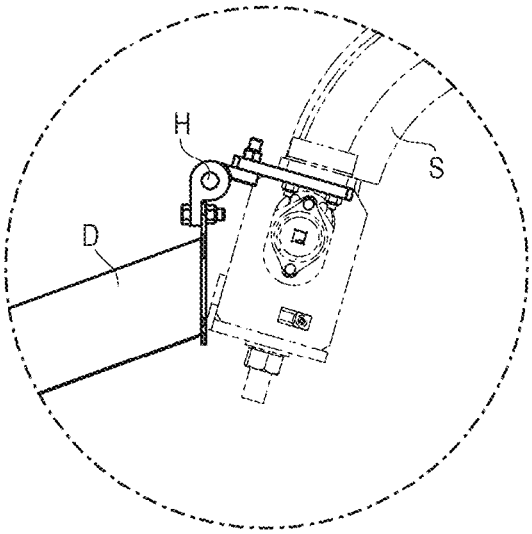
FIG. 28 is an enlarged detail view of the diverter shown in FIG. 27.
Figure 29:
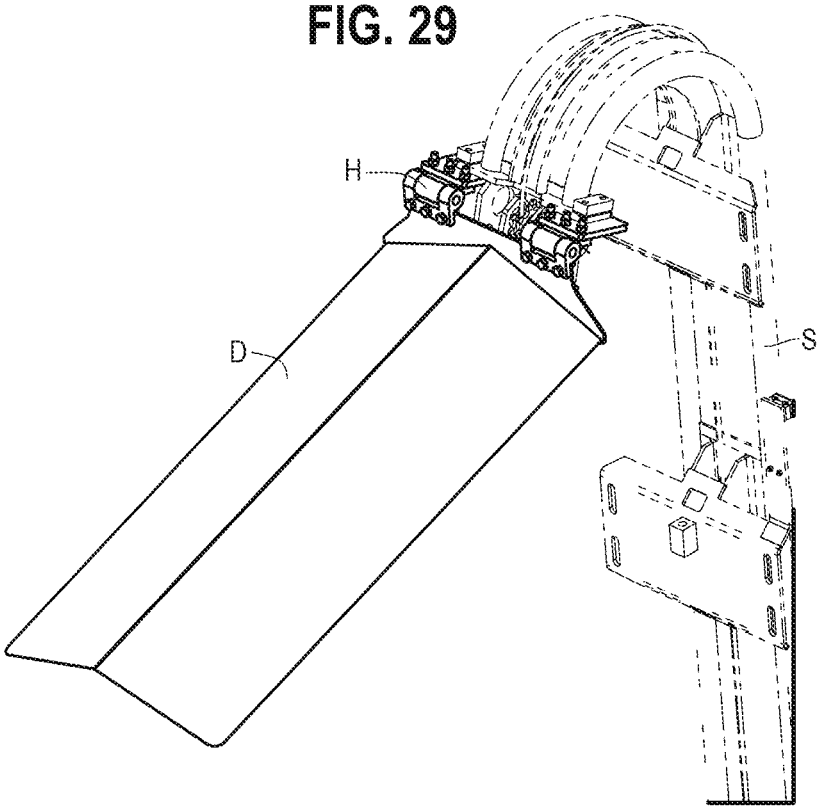
FIG. 29 depicts a front perspective view of the diverter shown in FIG. 27.

FIG. 26 depicts a diverter according to at least one embodiment, which is structured so as to increase the amount of material diverted to the gaylords closest to a bin tipper.

Figure 30:
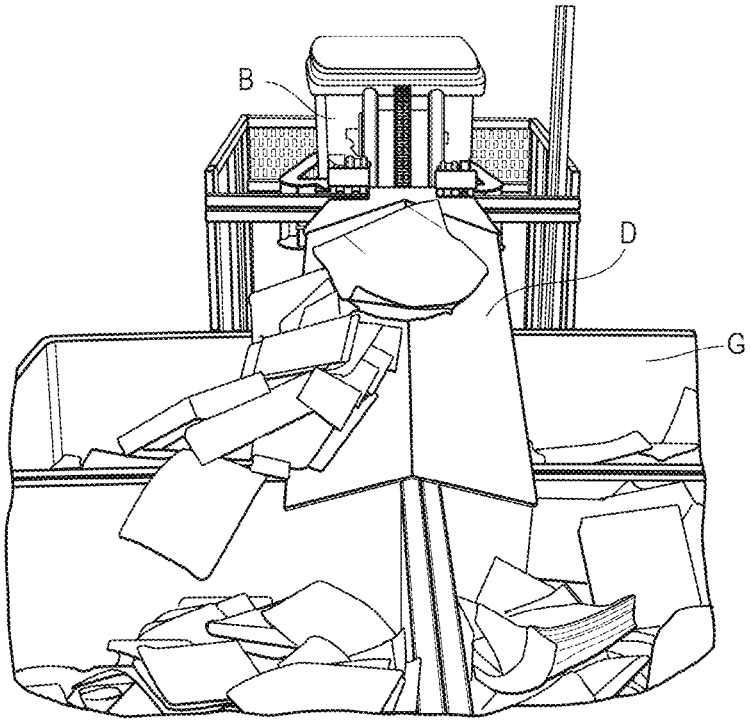
FIG. 30 is a front view illustrating a diverter in a use position in accordance with at least one embodiment.
Figure 31:
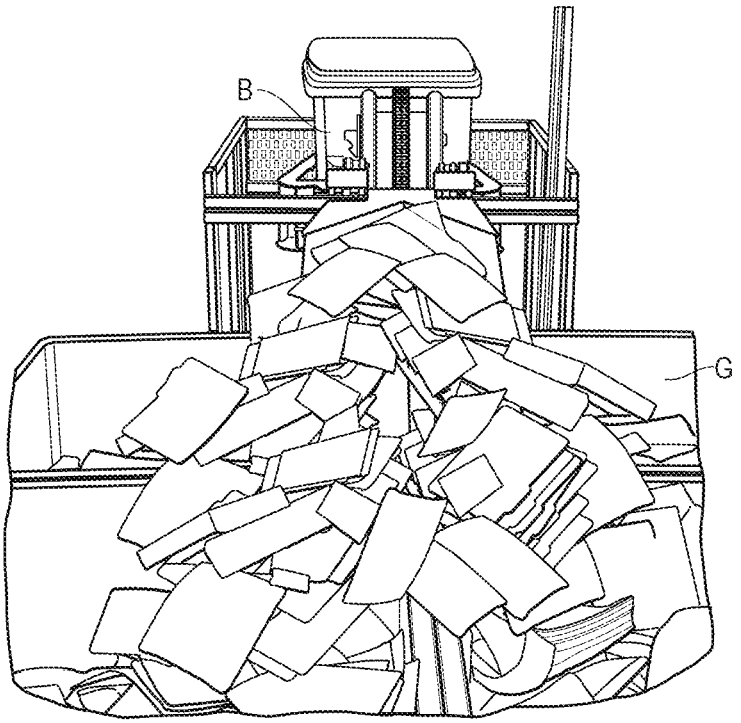
FIG. 31 is a front view illustrating a diverter in a use position in accordance with at least one embodiment.
Figure 32:
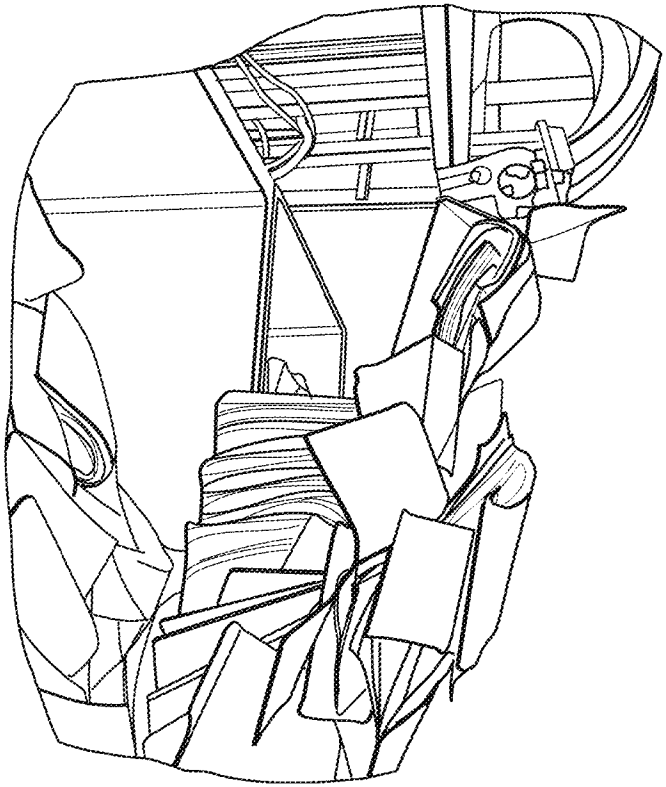
FIG. 32 is a side view illustrating a diverter in a use position in accordance with at least one embodiment.

FIGS. 30-32 depict a diverter D in use. FIG. 30 depicts a condition prior to discharging material from a final bin B of a plurality of bins whose contents have been discharged into the gaylords G by the bin tipper. FIG. 31 depicts a condition after the final bin B has been discharged. In this condition, material is distributed to at least one gaylord positioned farther from the bin tipper than at least one other gaylord. The material located on the diverter at a position closer to the bin tipper supports additional material that is also located on the diverter. As seen in FIG. 31, some papers are piled on top of other papers along the diverter. This accumulation may prevent or impede material on top of the diverter from moving further, so as to limit distribution to the far gaylords. In such a condition, discharging additional material from the bins may increase the pile height (the height of accumulated material) on top of the diverter. Once the vehicle is in motion, it is expected that some material may be further distributed from the pile into the gaylords. In particular, utilizing a relatively low friction or slippery material for at least part of the diverter may facilitate distribution of the pile off the diverter and into the gaylords.

Further, in at least one embodiment, material that accumulates on the diverter may be distributed after the material within the gaylords accumulates to reach the diverter and when material starts to accumulate atop the diverter. In particular, lifting the diverter may be performed to cause the material to fall into a particular gaylord (e.g., the left gaylord shown in FIG. 30). The lifting may be accomplished with a hydraulic cylinder. Accordingly, utilizing the diverter in this manner may lessen the pile height after the final bin contents are discharged. In other words, lifting the diverter may be timed to ameliorate piling in the condition shown in FIG. 31. Further, discharging the bins when the diverter is raised into a relatively more horizontal position (the condition when the diverter portions are in positions PR1, PR2 shown in FIG. 19, for example), may promote falling of the material sideways, to fill empty space in the gaylords closer to the bin tipper.

With respect to the use of substantially any plural and/or singular terms herein, those having skill in the art can translate from the plural to the singular and/or from the singular to the plural as is appropriate to the context and/or application. The various singular/plural permutations may be expressly set forth herein for the sake of clarity.

As may be utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to precise numerical ranges. Accordingly, these terms should be interpreted as indicating that insubstantial or inconsequential modifications or alterations of the subject matter described and claimed are considered to be within the scope of the inventions as recited in the appended claims.

The terms "coupled," "connected," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the figures of this application. It should be noted that the orientation of various elements may differ according to other exemplary embodiments, and that such variations are intended to be encompassed by the present disclosure.

The construction and arrangement of the elements of devices as shown in the exemplary embodiments, are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, orientations, etc.) without materially departing from the novel teachings and advantages of the subject matter recited. For example, elements shown as integrally formed may be constructed of multiple parts or elements, the position of elements may be reversed or otherwise varied, and the nature or number of discrete elements or positions may be altered or varied.

Additionally, the word "exemplary" is used to mean serving as an example, instance, or illustration. Any embodiment or design described herein as "exemplary" is not necessarily to be construed as preferred or advantageous over other embodiments or designs (and such term is not intended to connote that such embodiments are necessarily extraordinary or superlative examples). Rather, use of the word "exemplary" is intended to present concepts in a concrete manner. Accordingly, all such modifications are intended to be included within the scope of the present disclosure.

While various embodiments of the invention have been described, the invention is not to be restricted except in light of the attached claims and their equivalents. Moreover, the advantages described herein are not necessarily the only advantages of the invention and it is not necessarily expected that every embodiment of the invention will achieve all of the advantages described.

We claim:

1. A collection system, comprising:

at least one storage compartment comprising a plurality of regions;

a bin for transporting material from a first environment towards the storage compartment; and a diverter, wherein the diverter is dimensioned to distribute material among the plurality of regions within the storage compartment, where the diverter has a first position during use in which at least a portion of the diverter is positioned below the bin when the bin is in a raised position for emptying material, where at least a portion of the diverter is positioned above the plurality of regions in the first position during use, and where the diverter comprises two angled pieces that merge with one another at a seam along an axial centerline of the diverter.

2. The system of claim 1, where the diverter is configured to move from the first position during use to a second position when the diverter is being stowed.

3. The system of claim 1, where the diverter comprises a vertical splitter extending along a portion of a central longitudinal axis of the diverter.

4. The system of claim 1, where the diverter is structured to rest on and be supported by one or more gaylords positioned within the storage compartment in at least one of the first position during use or a second position when stowed.

5. The system of claim 4, where the diverter comprises a ledge portion that is supported directly on at least one gaylord when the diverter is in the first position during use, the ledge portion having a horizontal component that is configured to be disposed flush atop one or more gaylords.

6. The system of claim 4, where the diverter comprises a chute having a front plate and a side plate, where the front plate comprises a first notch dimensioned to surround two gaylord sidewalls, and the side plate comprises a second notch dimensioned to surround another two gaylord sidewalls.

7. The system of claim 1, where the diverter is mounted to a bin tipper, and is movable in at least one direction relative to the bin tipper.

8. The system of claim 7, further comprising a hinge that couples the diverter to the bin tipper, and a cylinder that is actuatable to rotate the diverter relative to the bin tipper around the hinge.

9. The system of claim 1, where the diverter distributes material in a substantially uniform distribution among a plurality of gaylords positioned within the storage compartment.

10. The system of claim 1, wherein the collection system is a mobile collection system.

11. A collection system, comprising:

at least one storage compartment;

a bin for transporting material from a first environment towards the storage compartment; and a diverter, wherein the diverter is dimensioned to distribute material within the storage compartment, the diverter distributing material simultaneously into two distinct regions in the storage compartment, where the diverter has a first position during use in which the diverter distributes material emptied from the bin, and where the diverter is configured to move from the first position during use to a second position when the diverter is being stowed.

12. The system of claim 11, wherein the at least one storage compartment comprises a plurality of gaylords, and where the diverter distributes material in a substantially uniform distribution among a plurality of gaylords.

13. The system of claim 11, where the diverter comprises two angled pieces that merge with one another at a seam along an axial centerline of the diverter.

14. The system of claim 11, where the diverter comprises a vertical splitter extending along a portion of a central longitudinal axis of the diverter.

15. A method for collecting material, the method comprising:

providing at least one storage compartment comprising a plurality of regions;

moving a bin for transporting material from a first environment towards the storage compartment;

using a diverter to distribute material among the plurality of regions within the storage compartment, where the diverter has a first position during use in which at least a portion of the diverter is positioned below the bin when the bin is in a raised position for emptying material, where at least a portion of the diverter is positioned above the plurality of regions in the first position during use; and moving the diverter from the first position during use to a second position when the diverter is being stowed.

16. The method of claim 15, further comprising using the diverter to distribute material in a substantially uniform distribution among a plurality of gaylords positioned within the storage compartment.

17. A collection system, comprising:

at least one storage compartment comprising a plurality of regions;

a bin for transporting material from a first environment towards the storage compartment; and a diverter, wherein the diverter is dimensioned to distribute material among the plurality of regions within the storage compartment, where the diverter has a first position during use in which at least a portion of the diverter is positioned below the bin when the bin is in a raised position for emptying material, where at least a portion of the diverter is positioned above the plurality of regions in the first position during use, and where the diverter comprises at least one wing flap that is coupled to a side of the diverter and capable of movement with respect to a remainder of the diverter.

18. A collection system, comprising:

at least one storage compartment comprising a plurality of regions;

a bin for transporting material from a first environment towards the storage compartment; and a diverter, wherein the diverter is dimensioned to distribute material among the plurality of regions within the storage compartment, where the diverter has a first position during use in which at least a portion of the diverter is positioned below the bin when the bin is in a raised position for emptying material, where at least a portion of the diverter is positioned above the plurality of regions in the first position during use, where the diverter is structured to rest on and be supported by one or more gaylords positioned within the storage compartment in at least one of the first position during use or a second position when stowed, and where the diverter comprises a ledge portion that is supported directly on at least one gaylord when the diverter is in the first position during use, the ledge portion having a horizontal component that is configured to be disposed flush atop one or more gaylords.

19. A collection system, comprising:

at least one storage compartment comprising a plurality of regions;

a bin for transporting material from a first environment towards the storage compartment; and a diverter, wherein the diverter is dimensioned to distribute material among the plurality of regions within the storage compartment, where the diverter has a first position during use in which at least a portion of the diverter is positioned below the bin when the bin is in a raised position for emptying material, where at least a portion of the diverter is positioned above the plurality of regions in the first position during use, and where the diverter is mounted to a bin tipper, and is movable in at least one direction relative to the bin tipper.

20. A collection system, comprising:

at least one storage compartment comprising a plurality of regions;

a bin for transporting material from a first environment towards the storage compartment; and a diverter, wherein the diverter is dimensioned to distribute material among the plurality of regions within the storage compartment, where the diverter has a first position during use in which at least a portion of the diverter is positioned below the bin when the bin is in a raised position for emptying material, where at least a portion of the diverter is positioned above the plurality of regions in the first position during use, where the diverter distributes material in a substantially uniform distribution among a plurality of gaylords positioned within the storage compartment, wherein four gaylords are provided, and wherein the diverter is configured to distribute approximately a quarter of a quantity of material to each of the four gaylords.

* * * * *